United States Patent [19]

Doriel

[11] 3,966,232

[45] June 29, 1976

[54] PARKING CARDS

[75] Inventor: Joseph Doriel, Tel Aviv, Israel

[73] Assignee: P.I.D. Patents and Inventions Development Limited, Tel Aviv, Israel

[22] Filed: Dec. 30, 1971

[21] Appl. No.: 214,158

[30] Foreign Application Priority Data

Feb. 18, 1971 Israel ..... 36227

[52] U.S. Cl. ..... 283/23; 40/5

[51] Int. Cl.[2] ..... G09F 3/00

[58] Field of Search ..... 283/23–33, 283/8–16

[56] References Cited

UNITED STATES PATENTS

| | | | |
|---|---|---|---|
| 456,862 | 7/1891 | Tangeman | 283/16 |
| 1,176,404 | 3/1916 | Roach | 283/12 |
| 1,280,548 | 10/1918 | Reynolds | 283/12 |
| 1,409,706 | 3/1922 | Goosman | 283/9 A |
| 2,839,854 | 6/1958 | Marinet | 283/23 X |
| 3,528,186 | 9/1970 | Roda | 283/23 X |

FOREIGN PATENTS OR APPLICATIONS

| | | | |
|---|---|---|---|
| 379,818 | 8/1964 | Switzerland | 283/23 |

*Primary Examiner*—Lawrence Charles
*Attorney, Agent, or Firm*—Hubbell, Cohen, Stiefel & Gross

[57] ABSTRACT

Parking cards for displaying prepaid parking time periods. The card is in the form of a strip of tearable material having month, day and hour indicia printed on separate areas thereof, each of the indicia areas being formed with tear lines enabling the user to tear away a part of the card along selected tear lines to identify the month, day and expiration hour of the prepaid parking time period, this tearing away producing a readily-discernible irreversible alteration in the card.

4 Claims, 4 Drawing Figures

PARKING CARDS

BACKGROUND OF THE INVENTION

The present invention relates to parking cards for displaying prepaid parking time periods.

At the present time, prepaid parking is conventionally controlled by the use of mechanical parking meters in which the user inserts the appropriate amount of coin currency for the period of time he expects to use the parking space, up to a predetermined maximum period. There are a number of disadvantages in using parking meters, among which are: the investment required for their purchase, installation and maintenance; the cost in collecting the coins from the meters; the difficulty in relocating them; the disputes which frequently arise as to whether the meter was properly functioning or not; and the susceptibility of the meters to vandalism and their contents to theft.

BRIEF SUMMARY OF THE INVENTION

The present invention provides a parking card which is purchased by the user in advance and displayed by him at the time of use to indicate a prepaid parking time period. The card is in a form of a strip of tearable material having month, day and hour indicia printed in separate areas. Each of the indicia areas is formed with tear lines enabling the user to tear away a part of the card along selected tear lines to identify the month, day and expiration hour of the prepaid parking time period. This tearing away may be done in a very simple and quick manner, without any tool, and produces a readily-discernible, irreversible alteration in the card, preventing it from being used a second time.

The invention can this be considered as including a combination of cuts and prints made on tearable material, such as strong paper or cardboard, which serves the mechanical purpose of marking parking time in a non-alterable way without any auxiliary tools, instead of doing the same by means of mechanical parking meters.

According to one feature of the invention, the tear lines in the card in at least one of the indicia areas are each in the form of a continuous cut defining a tab which may be pressed out of the card, the ends of said continuous cut terminating adjacent to but spaced from the edge of the card or another continuous cut, forming a connecting web portion between the card and the tab, whereby the user may press the tab out of the card along said continuous cut, and pull same to cause the card to be torn along said connecting web portion.

According to a further feature of the invention, this tab wider at its outer end than at its inner end, e.g., is in the form of a triangle, with the expiration time printed at the apex or inner an of the triangle, the earliest permitted arrival time for the respective expiration time being printed along the upper cut line of the tab, and the latest permitted arrival time for the respective expiration time being printed along the lower cut line of the tab.

As indicated earlier, a number of these cards are to be purchased by the user, preferably in the form of packs, and are to be used as required by tearing away a portion of the card to indicate a specified month, day and hour of prepaid parking time, and then displaying the card within the automobile, for example by leaning it or hanging it against the side window.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
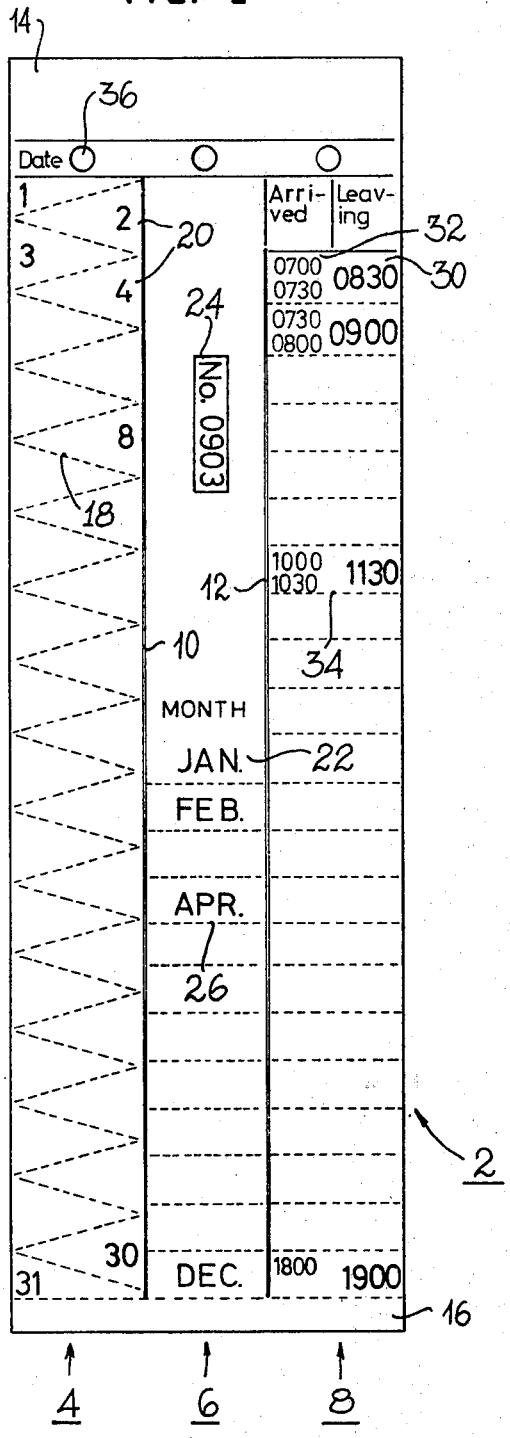
FIG. 1 illustrates one form of parking card.
Figure 2:
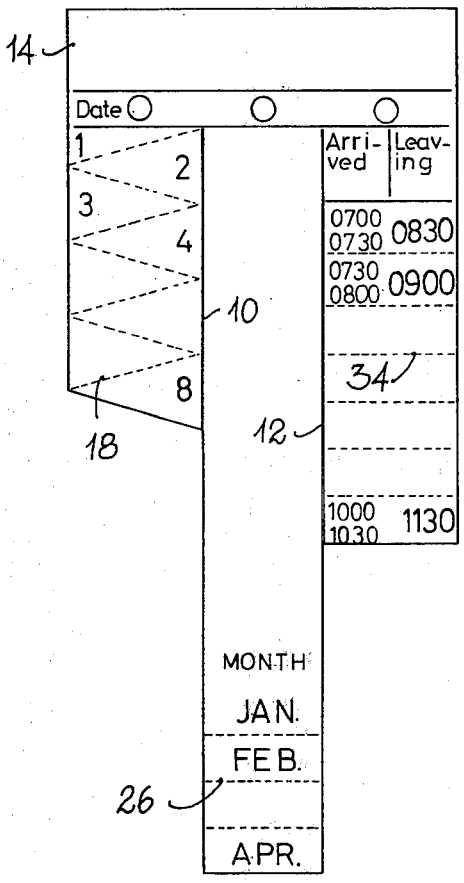
FIG. 2 illustrates the parking card of FIG. 1 after a part of it has been torn away to indicate a specified month, day and hour of prepaid parking.

The parking card illustrated in FIGS. 1 and 2 comprises a strip 2 of tearable material, such as strong paper or cardboard. The card contains month, day and hour indicia printed in parallel vertical columns, namely, column 4 which contains the "day" indicia, column 6 which contains the "month" indicia, and column 8 which contains the "hour" indicia. Each pair of adjacent columns are separated by a vertical slit 10, 12, the slits terminating short of the top and bottom edges of the card so as to provide a top connecting web portion 14 and a bottom connecting web portion 16 between the two slits.

The indicia column 4 containing the day indicia is formed with a plurality of tear lines 18 extending in zig-zag fashion from the edge of the card to slit 10, thereby dividing this vertical column into a plurality of triangular spaces. The days of the month are printed within these spaces, as shown at 20, with the first day beginning at the top, and the remaining days being numbered consecutively downwardly. The day numbers appear in two columns which are staggered with respect to each other, that is number 1 appearing in the left column, number 2 appearing below and to the right of it, and number 3 being below and in the same column as number 1. The days are thus numbered through number 31.

The month column 6 contains the names of the month 22 beginning with January and extending through December in descending order. Since only 12 months need be printed in this column, less space is required, and therefore the upper part of the column may be used for other purposes, such as for providing a control number 24 to the card. The months 22 are separated by tear lines 26 extending horizontally from slit 10 to slit 12.

The hour column 8 contains hours indicia in two columns. That is to say, the right hand column 30 contains the expiration hour (or fraction thereof) of the prepaid parking time, this being printed in bold letters, whereas the left column 32 contains in less bold letters the earliest permitted arrival time for that expiration time, and below it the latest permitted arrival time for that expiration time. Thus, assuming that the parking card is good for one hour parking, if the right column 30 is marked for an 8:30 expiration time, the left column 32 would carry 0700 as the earliest arrival time and below it 0730 as the latest arrival time for that expiration time.

Tear lines 34 are formed in the card below each expiration time and extend from slit 12 to the edge of the card. These tear lines, as well as the others in the embodiment of FIGS. 1 and 2, are in the form of perforated lines.

To mark the card for a specified period of time, the user would tear the card along a selected tear line 18 for the respective day of the month, along a selected tear line 26 for the respective month, and along a selected tear line 34 for the selected expiration time. This will cause the lower portion of the card, including the lower web 16, to separate from the upper portion including the upper web 14, the separation being along the respective tear lines. Thus, when the card is displayed, the parking control officer can easily see the exact parking time identified by the card. Also, it will be appreciated that the card cannot be used a second time.

The upper connecting web portion 14 may be provided with openings 36 to facilitate displaying the card within the automobile, as for example by hanging same from a piece of string; or it may be bent and the window closed on it. This web portion, as well as the lower web portion 16 and the backside of the card, may be used for carrying instructions, advertising, and the like.

Figure 3:
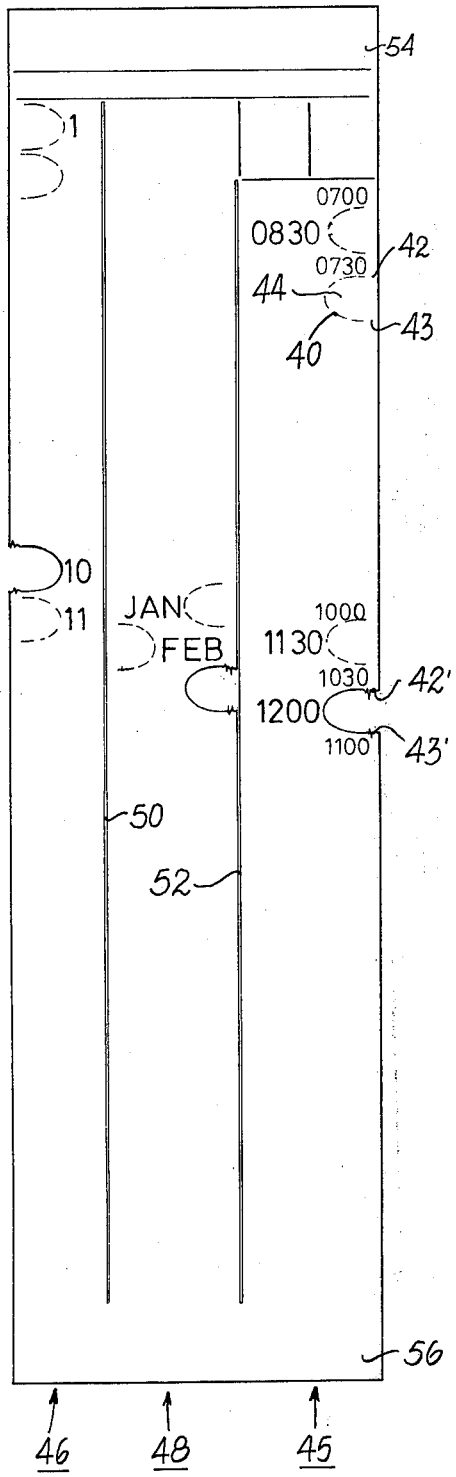
FIG. 3 illustrates another form of parking card constructed in accordance with the invention.

FIG. 3 illustrates another embodiment similar to that of FIGS. 1 and 2, except that the tear lines take a different form. Referring for example to the tear lines 40, it will be seen that each is in the form of a continuous cut which starts at a point adjacent to an edge of the card, but spaced slightly from the edge of the card to provide a connecting web portion 42. The tear line follows a predetermined contour, which in this case is curved, and terminates at another point adjacent to, but spaced slightly from the same edge of the card to provide another connecting web portion 43. To remove the tab portion 44 of the card defined by cuts 40 to indicate the selected time (hour of expiration, for example), the user presses his finger against the underside of the card to press out the tab 44 from the rest of the card. He can then grasp the tab with his fingers and pull it from the card. This results in tearing connecting web portions 42, 43, as shown at 42', 43' of the removed tab, producing thereby a readily-discernible, irreversible alteration in the card so that the card cannot be reused.

The foregoing structure of the tear lines 40 in FIG. 3 is described above with respect to the "hour" indicia column 45. Here the expiration hour (e.g. 11:30 a.m.) is boldly printed at the inner end of the open-bay-defining tear line, the earliest arrival time (e.g., 1,000, for a 1-hour parking card) being printed at the top of the tear line, and the latest permitted arrival time (e.g., 1030) being printed along the bottom tear line.

The same tear line configuration is provided with respect to the "day" column 46 wherein the day of the month (e.g. "10") is printed at the inner side of the tear line; and also with respect to the "month" column 48, wherein the month (e.g. "January") is printed at the inner side of the tear line.

This card also includes the two vertical slits 50,52 separating the indicia columns, and the two connecting web portions 54,56 above and below the slits.

Figure 4:
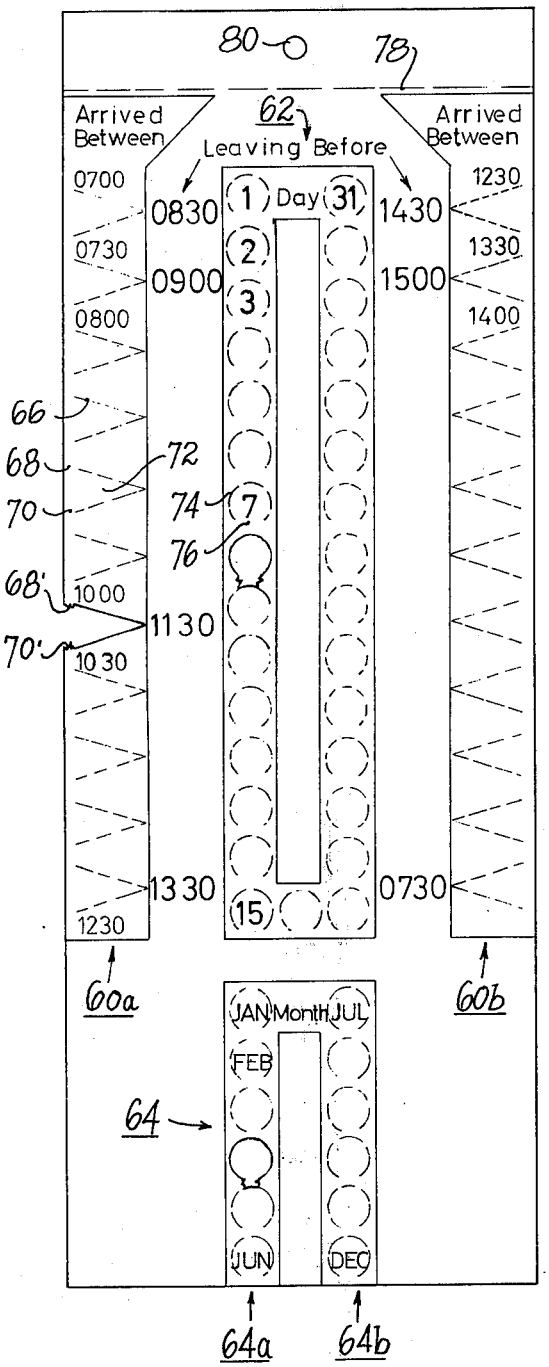
FIG. 4 illustrates a still further form of parking card constructed in accordance with the invention.

FIG. 4 illustrates an embodiment similar to that of FIG. 3, but with the following differences.

In the card of FIG. 4, the vertical slits (50,52 of FIG. 3) are omitted.

Also, the "hour" indicia is arranged along both edges of the card, as shown at 60*a* and 60*b*. Edge 60*a* has allotted to it the hours (expiration) 0700–1230, and edge 60*b* has allotted to it hours 1230–0730. The middle portion of the card 62 between the two edges 60*a* and 60*b* carries the "day" indicia, this indicia also being arranged in two columns in U-shape form, starting with 1 at the top of one leg of the U, and terminating with 31 at the top of the other leg. The "month" indicia is printed in the area 64 of the card immediately below the "day" area 62, the month indicia also being arranged in two vertical columns, 64*a* for the months of January – June, and 64*b* for the months of July – December.

Further, the tear lines for the "hour" indicia define tabs of triangular shape as shown at 66, with the expiration hour (e.g., 1130) being printed at the apex or inner end of its respective tab, the earliest permitted arrival time (e.g. 1000) being printed along the upper cut line of the tab, and the latest permitted arrival time (e.g. 1030) being printed along the lower cut line.

As in the embodiment of FIG. 3, tear lines 66 are each preferably in the form of continuous cuts which terminate short of the edge of the card, as shown at 68, 70, so that when a tab 72 defined by the tear lines is removed, in the manner described above with respect to FIG. 3, the card is actually torn at the connecting web portions 68', 70', thereby producing an alteration in the card which is irreversible and also readily-discernible, preventing the card from being reused.

The tear lines with respect to the "day" and "month" indicia are in the form of substantially circular cuts as shown at 74, but terminate short of a complete circle to form the interconnecting web portions 76 with the adjacent cuts. Thus, when tab defined by the tear lines is removed, the card will be torn along this interconnecting web portion 76, providing the readily-discernible irreversible alteration in the card preventing its reuse.

If desired, the top of the card in this embodiment, as well as in the previously described ones, may be formed with a fold line 78 permitting the upper edge to be folded down so that the card may be easily hung inside the vehicle window by closing the window on the folded edge. The card may also be formed with one or more holes 80 to facilitate hanging it from a hook or piece of string. Further, the top face of the card may be colored (e.g. different colors for the different indicia areas), to make the torn web portions more prominent. Also, the rules of use may permit the card to be used more than once.

Many other variations, modifications and applications of the illustrated embodiments will be apparent.

What is claimed is:

1. A parking card for displaying a prepaid parking time period, said card being in the form of a strip of tearable material having month, day and hour indicia printed on separate areas thereof, each of said indicia areas being formed with severance lines enabling the user to separate a part of the card in each of said areas along selected severance lines thereof to identify the month, day and the arrival and expiration times of the preselected prepaid parking time period;

the severance lines in at least one of said indicia areas each being in the form of a continuous cut defining a tab which may be pressed out of the card, the ends of each continuous cut terminating adjacent to but spaced from the edge of the card or another continuous cut, forming a connecting web portion between the card and the tab;

the tabs in at least one of said indicia areas being spaced along at least one edge of the card, each of said tabs having a generally triangular shape extending inwardly from the adjacent edge of the card to an apex and having the earliest and latest permitted arrival times printed adjacent one end of the tab and the expiration time printed adjacent the opposite end of the tab to define the preselected parking time period associated with that tab; and the relative lengths of the continuous cuts and connecting web portions, and the strength of the material providing the web portions, defining the respective tabs being such that the user may press each tab out of the card along said continuous cut, and pull same to cause the card to be torn along said connecting web portion, producing thereby a readily-discernible, irreversible alteration in the card.

2. A parking card as defined in claim 1, wherein said one indicia area contains the hour indicia and extends along at least one edge of the card, said hour indicia including the expiration time printed at the inner end of the respective tab, the earliest permitted arrival time for the respective expiration time printed along the upper cut line of the tab, and the latest permitted arrival time for the respective expiration time printed along the lower cut line of the tab.

3. A parking card as defined in claim 1, said card having a generally rectangular shape and wherein the hour indicia are printed along both longitudinal edges of said card, and the month and day indicia are printed in the middle of the card, the severance lines of the month and day indicia areas also each defining a continuous cut which may be pressed out of the card, the ends of said continuous cut terminating adjacent to but spaced from another adjacent cut forming the connecting web portion between the two.

4. A parking card as defined in claim 1, wherein severance lines each defining a continuous cut extend near to the edge of the card, the said web portion extending to the edge of the card, so that the user may press a tab out of the card along the continuous cut and tear the tab along the web, thereby creating an indentation in the edge of the card.

* * * * *